United States Patent [19]

Pez et al.

[11] 4,269,738

[45] May 26, 1981

[54] ELECTRICALLY CONDUCTING POLYMERS

[75] Inventors: Guido Pez, Boonton; Lowell R. Anderson, Morristown, both of N.J.

[73] Assignee: Allied Chemical Corporation, Morris Township, Morris County, N.J.

[21] Appl. No.: 957,635

[22] Filed: Nov. 3, 1978

[51] Int. Cl.[3] ..... H01B 1/00

[52] U.S. Cl. ..... 252/500; 252/518; 357/8; 357/15

[58] Field of Search ..... 252/500, 186, 518; 526/285, 231; 525/335, 353, 359; 357/8, 15

[56] References Cited

U.S. PATENT DOCUMENTS

| | | | |
|---|---|---|---|
| 3,293,233 | 12/1966 | Erchak et al. | 526/231 |
| 3,645,999 | 2/1972 | Byrd | 252/500 |
| 3,857,821 | 12/1974 | Becker | 526/285 |
| 3,933,722 | 1/1976 | Krutchen | 526/285 |
| 3,994,867 | 11/1976 | Baughman | 526/285 |

OTHER PUBLICATIONS

*J. Chem. & Phys.*, 68, pp. (5405–5409) (1978) by R. H. Baughman et al.

*J. Chem. Phys.*, 69, pp. (106–111) (1978) by Hsu, S. L. et al.

*J. Am. Chem. Soc.*, vol. 100, 1014–1016 (1978).

*Chemical and Engineering News*, pp. 19–20, (Apr. 24, 1978).

Physical Review Letters, vol. 39, p. 1098, (1977).

*J. Chem. Soc. Chem. Comm.*, pp. 578–580, 1977.

*J. Chem. Soc. Chem. Comm.*, 200–201, 1978.

*Primary Examiner*—Benjamin R. Padgett

*Assistant Examiner*—J. L. Barr

*Attorney, Agent, or Firm*—Robert A. Harman; Alan M. Doernberg; Gerhard H. Fuchs

[57] ABSTRACT

Electrically conducting polyacetylene compositions are described having incorporated therein a fluorine-containing peroxide, such as $FSO_2—O—O—SO_2F$. Preferred compositions exhibit novel metal-like conductivity at temperatures above about 150° K., and specific conductivities above about $10^2$ $ohm^{-1}$-$cm^{-1}$ at room temperature, as measured by the standard four-probe method. A process for producing the compositions is also described in which polyacetylene is contacted with the peroxide, preferably in an inert liquid solvent at low temperatures.

14 Claims, 2 Drawing Figures

ELECTRICALLY CONDUCTING POLYMERS

BACKGROUND OF THE INVENTION

1. Field of the Invention

This invention relates to novel electrically-conducting polyacetylene compositions having incorporated therein a fluorine-containing peroxide and a process for their manufacture.

2. Brief Description of the Background of the Invention Including Prior Art

Very few organic polymers are known in the art which are electrically conducting.

Examples of those that are known include polyacetylenes, wherein the respective cis and trans forms are "doped" with agents such as iodine and $AsF_5$, described in *J. Chem. Soc. Chem. Comm.*, pp. 578–580 (1977); *J. Chem. Phys.*, 68, pp. 5405–5409 (1978) by R. H. Baughman, S. L. Hsu, G. P. Pez and A. J. Signorelli; *J. Chem. Phys.* 69, pp. 106–111 (1978) by S. L. Hsu, A. J. Signorelli, G. P. Pez and R. H. Baughman; *Chemical and Engineering News*, pp. 19–20 (Apr. 24, 1978); *Physical Review Letters*, Volume 39, page 1098 (1977); and *J. Am. Chem. Soc.*, Volume 100, 1014–1016 (1978). However, while the above materials are electrically conducting, and described as exhibiting semiconductor conductivity, they are not described as exhibiting "metal-like" conductivity as measured by the standard "four-probe" test. Lightweight polymers, exhibiting metal-like conductivity, would be highly desirable for replacing heavier metallic conductors in selected electrical applications. Furthermore, in addition to the lack of described metal-like conductivity, the above-described polyacetylene doped with iodine, possesses the disadvantage of tending to release the incorporated "dopant" thus, causing a separating out of "dopant" from the polymer and subsequent loss of conductivity.

As a result of the recognized commercial potential in the above materials, there is a constant search in the art for new and better "dopants" which are securely held to the host polymer and in which both semiconducting and metal-like conductivity in the polymeric composition, such as polyacetylene, can be promoted, and improved processes for their manufacture.

By the term "metal-like conductivity", as used herein, is meant that the specific conductivity of the polymer composition increases monotonically with decreasing temperature over a certain range as illustrated by compositions II and III in the Figure. By the term "dopant" as used herein, is meant an added material incorporated into polyacetylene, thereby increasing the electrical conductivity of the polyacetylene composition. By the term "four-probe method", as used herein, is meant the known and accepted art method of measuring the electrical conductivity of a polymeric film or material using either A.C. or D.C. current between four contacts. Reference to the four-probe method is made in the *J. Am. Chem. Soc.* citation above, and hereby incorporated by reference. By the term "specific direct current conductivity" or "specific conductivity," as used herein, is meant that the inherent direct current conductivity, at a particular temperature T, being the reciprocal of the measured resistivity, of a film or strip, is adjusted by calculation on a volume basis of the material to indicate the relative and comparative conductivity of a cube of the material being 1 cm×1 cm×1 cm. Thus, the inherent conductivity is a direct result of the measurement and the specific conductivity is calculated.

The material, $FSO_2—O—O—SO_2F$, bisfluorosulfuryl peroxide, is described as oxidizing boron nitride to yield a first-stage boron nitride salt which acts as an electrical conductor as compared to layer-form boron nitride which is an insulator. See *J. Chem. Soc. Chem. Comm.*, 200–201 (1978). However, no mention of the material is made for its use in organic polymers and no specific mention is made of inducing metal-like conductivity or enhancing the specific conductivity of polyacetylene, by the use thereof.

SUMMARY OF THE INVENTION

We have unexpectedly found that fluorine-containing peroxides are useful as "dopants" in increasing the specific conductivity of polyacetylene, resulting in compositions exhibiting semiconductor conductivity. Further, we have unexpectedly found that by preferably applying the dopant to the polyacetylene, by a solution process at very low temperatures, polyacetylene compositions exhibiting metal-like conductivity can be obtained.

In accordance with this invention there is provided a composition comprising a solid polyacetylene having incorporated therein a fluorine-containing peroxide wherein the specific direct current conductivity of the composition is greater than that of said polyacetylene alone, as measured by the four-probe method at room temperature. A preferred embodiment is wherein said composition exhibits metal-like conductivity, and particularly preferred above about 150° K.

Further, there is provided a process for preparing the subject compositions comprising the step of contacting a solid polyacetylene with a fluorine-containing peroxide. A preferred embodiment of the process is wherein the peroxide is dissolved in an inert liquid solvent therefor, and contacted with said polyacetylene at a temperature below the boiling point of said solvent.

DESCRIPTION OF THE INVENTION AND PREFERRED EMBODIMENTS

Figure 1:
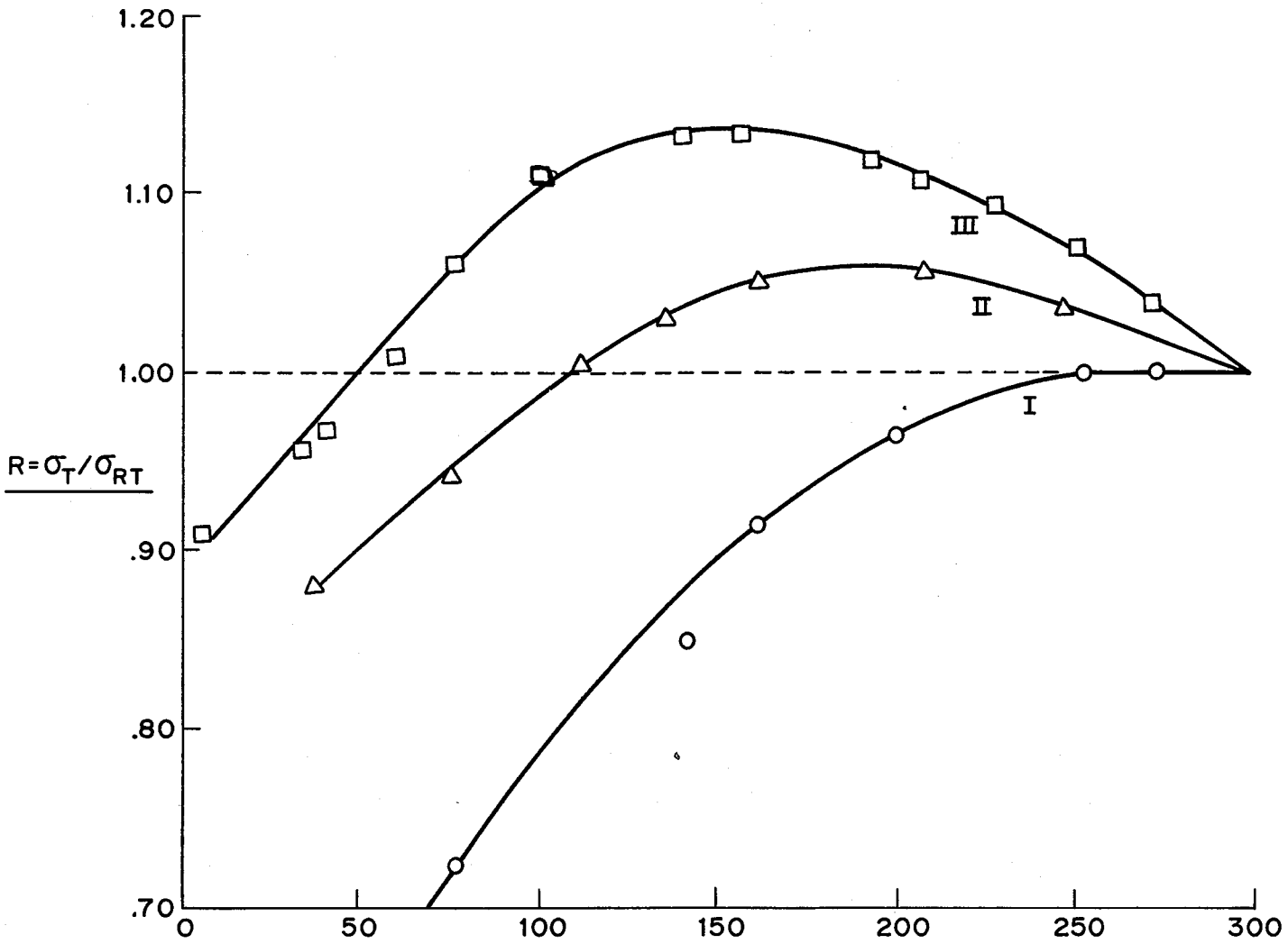
FIG. 1 depicts the conductivity behavior of three subject compositions as a plot of the ratio (R) of (specific conductivity, $\sigma_T$ at temperature T)/(specific conductivity $\sigma_{RT}$ at room temperature) vs. temperature in degrees Kelvin. Composition I behaves as a semiconductor, whereas compositions II and III exhibit metal-like conductivity in various temperature regions below room temperature.

The solid polyacetylene component of the subject composition is inherently a non-conducting material, i.e. an insulator, and by the term "non-conducting" is meant a conductivity lower than about $10^{-5}$ $ohm^{-1}$ $cm^{-1}$ as measured by the standard and accepted technique of the four-probe method described above. By contrast, the subject compositions have specific conductivities which are at least one hundred times greater than that of polyacetylene alone, as measured by the four-probe test under the same conditions at room temperature, and are at least about $10^{-3}$ $ohm^{-1}$ $cm^{-1}$ in value and preferably about $10^2$ $ohm^{-1}$ $cm^{-1}$.

The polyacetylene component can be in the cis or trans forms, or mixtures thereof, and preferably either predominantly in the cis or trans form. These geometric isomer forms of polyacetylene are well known in the art as well as their physical properties and methods of synthesis and are adequately described in the above-cited references, hereby incorporated by reference for that purpose. By the terms "cis" and "trans", as used herein, is meant that the respective material is comprised of at least about 70% weight percent of the stated form. For example, the cis form for purposes of this invention, contains at least about 70 weight percent of the cis form, the remainder being in the trans form. The reverse is true for the "trans" form.

It is particularly preferred to use polyacetylene which is in the cis form, and preferably, the material made by a process utilizing a highly active catalyst for producing the cis geometric isomer, preferably in "gel" form, as described by Guido Pez in *J. Chem. Phys.* 69, p. 106 (1978), hereby incorporated by reference.

The polyacetylene component preferably has a density of about 0.90 g./cc. and more preferably about 0.94 g./cc. Higher densities are considered to lead to greater specific conductivities of the subject compositions.

The polymer chains of the polyacetylene component used in this invention can be randomly-oriented or can be partially axially oriented in a particular direction in the subject compositions. The condition of partial axial orientation is known in the art to be achieved by a "stretching" of the polymer longitudinally along one axis, by means of conventional devices, and the resulting orientation can be readily evidenced by resulting anisotropic effects in an X-ray diffraction pattern thereof, as described in *J. Polymer Sci. Polymer Ed.* 12, p. 11–20 (1974). It is considered that partial axial orientation of the polyacetylene component leads to enhanced specific conductivity in the subject composition.

The polyacetylene is in solid form and can be amorphous or partly crystalline and by the term "partly crystalline" is meant that the polymer exhibits a distinctive peak at 23°–24° ($2\theta$) in its X-ray diffraction pattern as measured by Cu K-alpha radiation. See the above-mentioned reference of *J. Chem. Phys.* 68, 5405–5409 (1978). It is considered that the specific conductivity of the subject compositions is significantly enhanced by high crystallinity of the polymer used.

A fluorine-containing peroxide is the "dopant" in the subject compositions and can be an organic or inorganic peroxide, or mixtures thereof, containing fluorine. By the term "fluorine-containing" is meant that the compound contains at least one fluorine atom per molecule and preferably two. The chemical structure of the peroxide can be unsymmetrical or symmetrical and is preferably symmetrical. The reason why the incorporation of a fluorine-containing peroxide into polyacetylene significantly increases the specific conductivity is not well understood.

Representative examples of fluorine-containing peroxides applicable in the instant invention include bisfluorosulfuryl peroxide, $FSO_2—O—O—SO_2F$; bistrifluoromethylsulfuryl peroxide, $CF_3—SO_2—O—O—SO_2—CF_3$; bistrifluoroacetyl peroxide, $CF_3CO—O—O—COCF_3$, bistrifluoromethyl trioxide $CF_3O—O—OCF_3$, and bistrifluoromethyl peroxide, $CF_3OOCF_3$. A preferred peroxide for producing in the subject compositions is bisfluorosulfuryl peroxide.

The amount of fluorine-containing peroxide incorporated into the subject compositions is about 0.001 to 40 weight percent of the weight of polyacetylene present in the composition. A preferred amount is about 15 to 30 weight percent of the weight of polyacetylene, being said peroxide incorporated therein.

By the term "incorporated therein" is meant that it is considered the peroxide is most likely covalently bonded to the polyacetylene, such that the peroxide is not readily separable or extractable from the polyacetylene.

The physical properties of the subject compositions include a greyish light-reflecting color and a flexibility which is about the same as for the polyacetylene alone. However, a slight amount of tarnishing of the surface coloration and loss in flexibility of the polymeric material may occur as a result of the application of the fluorine-containing peroxide agent, but is not significantly deleterious with respect to its usefulness as an electrical conductor or semiconductor.

The specific conductivity of the subject compositions is a function of temperature, and is in the range of about $10^{-3}$ to $10^{3}$ $ohm^{-1}$ $cm^{-1}$, preferably at least about $10^{2}$ $ohm^{-1}$ $cm^{-1}$, as measured at room temperature, although higher specific conductivities may also be achieved by the use of more dense or more crystalline polyacetylene materials or those in which the polymer chains are partially axially oriented to a degree. The specific conductivity of the polyacetylene component alone, by comparison, is generally about $10^{-7}$ to $10^{-5}$ $ohm^{-1}$ $cm^{-1}$ as measured at room temperature by the four-probe method. It is considered that the specific conductivity of the compositions, particularly those prepared by the low-temperature solution process, remains fairly constant at a given temperature over a period of several weeks in an inert atmosphere. Contact of the subject compositions with vapors such as water, ammonia or acid, is felt to cause some loss in specific conductivity, particularly water, and thus, the subject compositions, should be used as semiconductors or conductors in electronic applications where the components are present in an evacuated system, or in an inert atmosphere, in the absence of such vapors.

The subject compositions may behave as semiconductors as illustrated by Composition I in the Figure, wherein the specific conductivity monotonically decreases as a function of temperature at continuously decreasing temperatures below room temperature. Semiconducting behavior of the compositions is thought to result from rapid incremental additions or excessive application (additional increments of said peroxide beyond the point where maximum conductivity is observed during the doping process) of the fluorine-containing peroxide to the polyacetylene in the absence of a solvent as described in Example 1.

The subject compositions may also exhibit "metal-like" conductivity in that the specific conductivity will monotonically increase with continuously decreasing temperatures to some maximum value below room temperature. As illustrated, Composition II exhibits a continuously increasing specific conductivity to a maximum value of about 480 $ohm^{-1}$ $cm^{-1}$ at 111° K., whereas Composition III exhibits a continuously increasing specific conductivity to a maximum value of about 797 $ohm^{-1}$ $cm^{-1}$ at about 150° K. Modifications and variations in the disclosed process herein for "doping" the polyacetylene are expected to yield subject compositions exhibiting "metal-like" conductivity at even lower temperatures. A particularly preferred composition is that which exhibits "metal-like" conductivity above about 150° K. It is thought that "metal-like" conductivity is achieved by low temperature controlled incremental application of the fluorine-containing peroxide, in a solvent therefor, which minimizes degradation effects of the peroxide. Not only do these compositions exhibit metal-like conductivity in specific regions below room temperature, but also are seen to retain up to about 70–90% of their room temperature specific conductivity at extremely low temperatures, e.g. 4.2° K., as for Composition III, which greatly increases their usefulness in electronic applications at low temperature, e.g. in cryogenic applications. It is considered that the specific conductivity of the Compositions I, II, III, above room temperature will in general follow the trend of the respective curve to some limiting value. The details of preparation of Composition II is described in Example II and that of Composition III is described in Example III, wherein both subject compositions are prepared by the incremental addition of bisfluorosulfuryl peroxide to cis-polyacetylene immersed in liquid sulfuryldifluoride, $SO_2F_2$, at temperatures from about 162° to 223° K.

The physical form of the doped polyacetylene compositions of this invention is generally a film, such as a rectangular strip, square, or other article of any desired shape taking into account respective desired end-use applications and convenience of applying the dopant. Alternately, the subject compositions may be formed as a strip and then subsequently fabricated by known methods into a final desired shape. It is preferred to utilize polyacetylene in the form of a thin film, as uniform as possible, or strip for application of the dopant, during the doping process. Strips ranging in sizes of about 0.28–0.91 mm thick, 7.6–12 mm wide and 15–40 mm long were found to be suitable although not limited thereto.

The subject compositions may also be combined with other materials to produce useful semiconductor or conductor devices. For example, the subject compositions may be deposited onto silicon dioxide or germanium surfaces, or the like, or the subject compositions can be coated on the surface of a copolymer used in electronic applications, or the subject compositions can be blended with other polymers such as polyethylene, polystyrene, and the like and used to fabricate articles such as electrical components. These combinations and other substrates useful in coating and blending, are embraced within the term "composition" and will be obvious to one skilled in the art from the disclosure herein.

A particularly preferred embodiment of the subject compositions is where the polyacetylene is about 86% in the cis form, has a density of about 0.94 g./cc., and bisfluorosulfurylperoxide is the peroxide present in an amount of about 15 to 35 weight percent, and preferably about 21 weight percent, of the weight of polyacetylene in the composition. Such compositions will in general exhibit specific conductivities of 102 $ohm^{-1}$ $cm^{-1}$ and higher at room temperature and lower temperatures.

A process for preparing the subject compositions is also subject of this invention. The process generally comprises contacting polyacetylene, in convenient form such as a film, with a fluorine-containing peroxide, wherein the nature and scope of said materials are discussed hereinabove.

The contacting step may be performed in an enclosed or evacuable system to protect against escape of the peroxide dopant. Preferably, this step is performed in an evacuable system such that increments of the peroxide, as a gas, can be made. It is also preferred to conduct the contacting step wherein the polyacetylene film or strip is connected to the four-probe apparatus for measuring the increase in conductivity, during the contacting step. The apparatus, details of which are given below, can be assembled by joining the polyacetylene strip to four platinum electrode leads which are connected to a current source and a sensitive digital voltmeter wherein the continuous measuring and monitoring of the conductivity of the strip can be performed. The entire apparatus for the addition of the dopant is preferably housed in an evacuable glass vessel, with inlet and outlet ports for the peroxide and a cooling bath for the bottom of the vessel.

It is preferred to conduct the contacting step at initial reduced pressures preferably below atmosphere pressure at about 5 to 75 mm, and preferably below that of the room temperature vapor pressure of the peroxide to avoid condensation of the peroxide in the assembly. This is due to the fact that it is thought that contact of the concentrated liquid peroxide with the polyacetylene strip leads to polymer degradation. The peroxide is introduced in gaseous form, in controlled measured increments in amounts corresponding to about 5–75 mm pressure increases at the temperature employed, into the evacuated vessel to contact the polyacetylene. By the term "controlled measured increments" is meant that the peroxide is introduced in small measured portions of the total amount of peroxide needed to increase the weight of the formed composition by 0.001 to 40 percent by weight as opposed to rapid addition of the peroxide in one or two portions, for example. This procedure is continued over the course of several hours or days until a maximum conductivity is observed. By this procedure of addition of peroxide in controlled measured increments, a material corresponding to Composition I in the Figure is obtained which exhibits semiconducting behavior. Rapid incremental addition of the peroxide will lead to variations in the semiconducting properties. Various modifications of the above-described process in this disclosure will be obvious to one skilled in the art as to the technique of obtaining doped polyacetylene exhibiting various degrees of semiconducting behavior.

A preferred embodiment of the invention process is the above-described process and apparatus additionally employing an inert liquid solvent for the peroxide, and conducting the contacting step at a temperature below the boiling point of said solvent. By the use of a solvent, in which the polyacetylene is insoluble, controlled incremental additions of the peroxide to the polyacetylene at low temperatures are considered to result in subject compositions possessing "metal-like" conductivity, described hereinabove.

Figure 2:
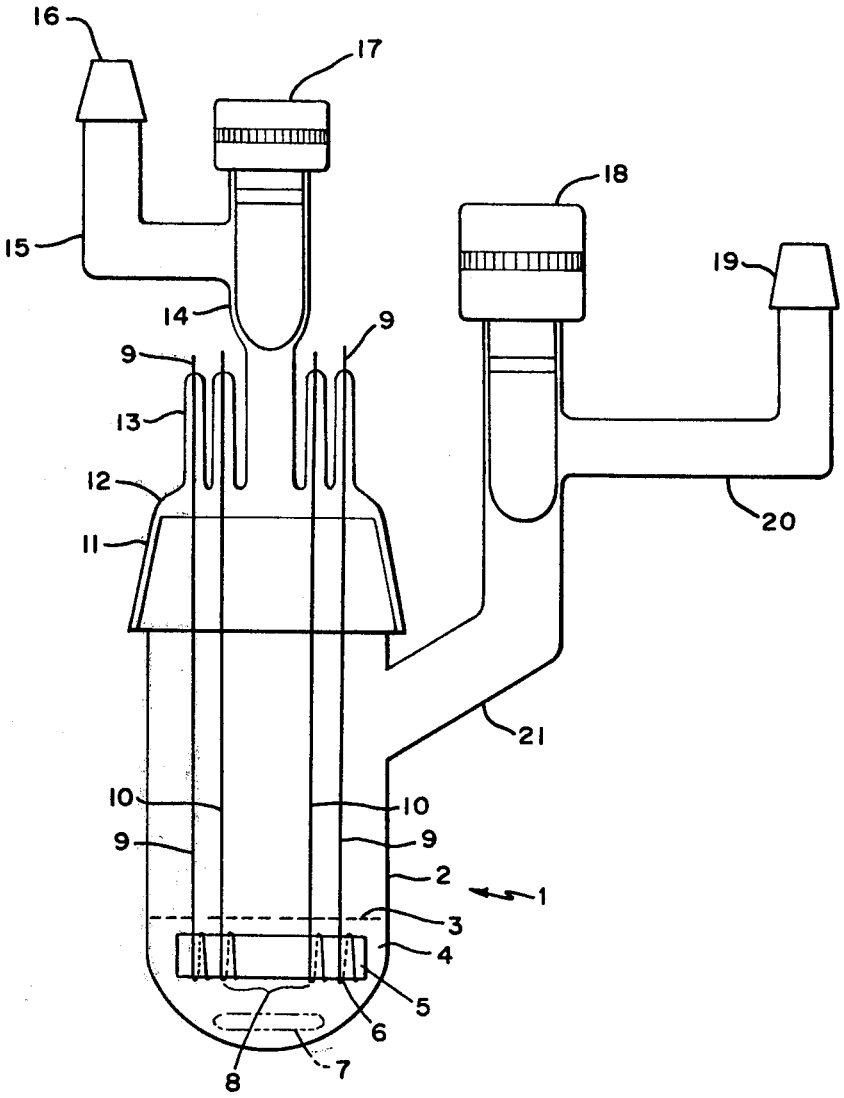
FIG. 2 is an illustration of the basic portion of the apparatus used for the determination of inherent conductivity in the four-probe test, and used in the doping process.

A preferred apparatus for conducting the contacting step and measuring the conductivity of the subject composition by the four probe test, used herein, is illustrated in FIG. 2. A glass evacuable cell 1, of 185 milliliter volume capacity, is composed of an upper section 12 reversibly mounted onto lower section 2, by means of a standard 45/50 tapered joint 11. Lower section 2 containing an adjoining sidearm 21 leading to a Teflon tap 18, being a means for allowing solvent entry into sidearm 20 leading to male joint 19 which can be attached to a suitable flask (not shown) for removal of solvent.

Lower section 2 can be cooled and the pressure in the apparatus regulated by immersion into a cooling means (not shown) such as a Dewar flask containing liquid nitrogen or a slush bath of known freezing point. Upper section 12 is equipped with a center neck 14 containing Teflon tap 17, being a means for connecting the system to the vacuum source, and to the means for addition of solvent and dopant, through sidearm 15 connected by male joint 16 to said vacuum source and means for addition of materials. Upper section 12 also contains four vertically positioned elongated graded glass seals 13, wherein the two outside seals contain platinum wires 9, both connected to a standard current source, and two inner seals containing platinum wires 10 connected to a digital voltmeter. Optionally, the platinum wires can be surrounded by glass tubing (not shown) extending into the lower section to avoid contact between the wires. The platinum wires extend into the inner region of lower section 2 and are connected to a polyacetylene strip 5, at four polymer-wire junctions 6, said assembly being immersed in solvent 4 below the level of solvent indicated by dotted line 3. The distance 8 between the two center polymer-wire junctions is at a practical maximum value. A mechanical stirring bar 7 allows for thorough mixing and uniform distribution of dopant in the solvent.

A preferred embodiment of the invention process is generally conducted by attaching the platinum wires to the polyacetylene strip, by simple pressure contact and winding each wire about one or two turns about the strip as illustrated in FIG. 2 by the dotted lines on the strip. The polyacetylene strip is positioned in a standing position on its side edge. An electrically-conducting cement, such as Electrodag TM, a colloidal graphite gormulation, is then applied to each polymer-wire junction winding to securely hold the strip in place. Generally, the distance between the two center platinum wire leads is about 1–3 cms. The apparatus is then assembled by joining the upper and lower sections by means of Voltalef 90 TM vacuum stopcock grease, a polychlorotrifluoroethylene formulation, and vacuum is applied to about $5\times10^{-4}$ mm of mercury. A current of about 0.1 to 1 milliamps is applied by means of the current source (here housed in the voltmeter) through the outer wires, and the voltage drop and resistance measured by a Keithley Instruments 163 Digital Voltmeter/Current Source by means of the inner center leads which are attached thereto. By Ohm's law calculation, the resistance is determined and the reciprocal determines the inherent conductivity. Solvent is then introduced into the system by means of a suitable stopcock assembly on the vacuum system, and the solvent in gaseous form is allowed to enter the lower section of the apparatus and condensed by means of a cooling bath, being liquid $N_2$ at −196° C. in the case of bisfluorosulfuryl peroxide, surrounding the lower section. Sufficient solvent is introduced such that the polyacetylene strip is totally immersed when the solvent is stirred, by means of the magnetic stirring bar and suitable magnetic stirrer (not shown) positioned below the lower section. The temperature during the doping process is measured externally by means of a thermometer in the surrounding cooling bath. The conductivity of the strip is again noted. The dopant is then incrementally introduced in gaseous form, by means of a suitable stopcock assembly on the vacuum system in the same manner as was the solvent. The increments are measured by noted pressure increases in the system. The gaseous dopant is condensed in the solvent at the low temperature employed and then the temperature is raised to a temperature at which the dopant interacts with the surface of a strip as noted by increases in conductivity. In the case of bisfluorosulfuryl peroxide, the temperature is raised from −196° C. to about −111° C. to −95° C. The solution is stirred until the conductivity has reached a maximum value, then the temperature is lowered again and the lower section is opened, and another fresh increment of gaseous dopant introduced, at the low temperature, warmed to a pre-determined reaction temperature, and stirred until a maximum conductivity is reached. This procedure is repeated until a maximum conductivity of the sample is obtained. The solvent is then removed by opening tap 18 and allowing liquid solvent to run through sidearm 20 into a suitable retaining flask. The solvent is allowed to evaporate back into the lower section, condensed, to wash the resulting strip. The solvent is then re-poured back into the retaining flask. This is repeated two or three times to completely wash the resulting strip. By evaporating solvent back into the lower section, in essence, fresh solvent is being used for the washing since impurities are now trapped in the retaining flask. After removal of the solvent, the apparatus is filled with $N_2$ gas at 1 atm. of pressure and room temperature to provide a thermally conducting atmosphere. Measurements of the conductivity are now made from room temperature and below by equilibrating the temperature within the flask with different "slush" cooling baths. For example, $CCl_4$ is frozen by use of liquid $N_2$ and allowed to thaw until a "slush" is obtained containing frozen $CCl_4$ in equilibrium with liquid $CCl_4$. The temperature at this point is −23° C. In the same manner, slush baths of the following, at the designated temperatures, were used: octane, −57° C; $CHCl_3$, −63° C.; dry ice and $CFCl_3$, −80° C.; toluene, −95° C.; $CFCl_3$, −111° C.; pentane, −130° C.; isopentane, −160° C.; and liquid $N_2$, −196° C.

The conductivity measurements are made at the temperature of the cooling bath after a sufficient equilibration time and then converted to specific conductivity values. The slush temperature is measured using a chromel-alumel thermocouple. In the general process, the same procedure and apparatus can be used, except that a gaseous dopant, in the absence of solvent, is employed. Also, in this case, the apparatus need not possess adjoining side arm 21 and resulting assembly for removal of solvent.

It is thought that by allowing the peroxide to dissolve in the solvent, prior to contacting the polyacetylene, a slower and more uniform rate of contacting occurs on the polyacetylene surface by the peroxide.

Solvents which can be used in the preferred embodiment must be a liquid at the temperature employed, and must be an inert solvent for the particular peroxide used. Representative examples of suitable solvents include sulfuryl difluoride, $SO_2F_2$; $SOF_2$; and $FSO_2O$-$SO_2F$. A preferred solvent is sulfuryl difluoride.

Amount of solvent used is about 50 to 250 times the weight of the polyacetylene strip used. However, this amount is not critical and smaller or larger amounts may be used as long as sufficient solvent is present to completely contact and cover the surface of the polyacetylene with dissolved peroxide for the "doping" step.

Temperature in the process is generally in the range of about −200° to +25° C. and preferably in the range from about −120° to −50° C., both in the general process and preferred embodiment thereof.

A particularly preferred embodiment of the process, in which a solvent is utilized, is where the solvent is sulfuryl fluoride, the initial pressure in the system is below atmospheric, preferably below about 1 mm, and bisfluorosulfuryl peroxide is introduced in controlled measured increments, as described above, in amounts of about 0.025 grams (1.25 millimoles) each, until the weight of the polyacetylene has increased by 15 to 35 percent, and preferably 21 weight percent. The polyacetylene in this embodiment is preferably prepared from a "polyacetylene gel" described by Guido Pez in the above-described reference, and can be mechanically compressed by suitable means to increase the density and optionally stretched by known methods to achieve partial axial orientation of the polymer chains, prior to the doping process. Both effects are considered to lead to enhanced specific conductivity. The resulting doped polyacetylene is then washed with solvent and dried under an inert atmosphere, such as nitrogen, argon and the like, and exhibits meta-like conductivity.

The following examples are illustrative of the best mode of carrying out the invention as contemplated by us and should not be construed to be limitations on the scope or spirit of the instant invention.

EXAMPLE 1

Bisfluorosulfuryl peroxide ($FSO_2OOSO_2F$) was prepared by the electrolysis of freshly distilled fluorosulfuric acid ($FSO_3H$) according to the method described *J. Chem. Soc.* 3407 (1963). The material formed at the anode during the electrolysis process and was collected under vacuum at −196° C. It was separated from unreacted fluorosulfuric acid and prepared for use in the process by fractionation through a −45° C. trap.

Cis polyacetylene film was prepared by passing acetylene gas onto an unstirred solution of $\alpha$-($\eta^1$:$\eta^5$-cyclopentadienyl)-tris($\eta$-cyclopentadienyl)dititanium (Ti-Ti) in hexane at −80° C., as described in the reference hereinabove, by Guido Pez. The titanium catalyst was present in a concentration of about 120 milligrams per liter. The resulting polyacetylene gel was dried by slow removal of solvent under vacuum to yield a polyacetylene film.

The "doping" of the polyacetylene film was carried out with continuous monitoring of the electrical conductivity in an apparatus similar to that described in FIG. 2 except that the lower section of the cell extended only about 2 inches below the tapered joint, and the cell was not equipped with a sidearm for solvent removal.

A strip of polyacetylene film (40 mm×8 mm×0.91 mm) was cut from the above-prepared sample and was wrapped tightly with four platinum electrodes, which were then covered with Electrodag TM. The bottom portion of the cell was then attached using Voltalef-90 TM stop-cock grease.

The center platinum wires were then connected to a Keithley Instruments 163 Digital Voltmeter, and the outer wires were connected to a current source. This permitted continuous independent monitoring of the voltage and current and hence resistance or conductivity by Ohm's Law calculations. The cell was then evacuated to a pressure of about $5\times10^{-4}$ mm. of mercury.

The initial specific conductivity of the undoped polyacetylene strip in vacuum at $5\times10^{-4}$ mm. pressure, was calculated to be $2.7\times10^{-5}$ $ohm^{-1}$ $cm^{-1}$. Bisfluorosulfuryl peroxide was then added to the cell initially in increments corresponding to 12 mm pressure increases while cooling the bottom portion of the cell using a cold bath having a temperature of about −23° C. to establish the desired pressure. An immediate increase in conductivity was noted. Over the next two to three days, incremental additions of the peroxide were made to the system, in increments greater than 12 mm of pressure, after removing the previous increment by evacuation. The final and highest increment used was an amount equal to a pressure of about about 100 mm. The pressure was always kept below the room temperature vapor pressure of $FSO_2OOSO_2F$ in order to prevent condensation of liquid peroxide in the container. The highest conductivity achieved was about 240 $ohm^{-1}$ $cm^{-1}$ which was greater by a factor of about 107 than the original conductivity of the undoped polyacetylene. Slight losses in conductivity were noted upon standing in vacuum or under dry argon over several days.

The specific conductivity of the doped polyacetylene strip prepared in this way is a function of temperature in that it behaves as a relatively small band gap semiconductor. That is, its conductivity decreases rather slowly and retains about 70% of its maximum conductivity even at −196° C. The best value of the specific conductivity obtained was about 240 $ohm^{-1}$ $cm^{-1}$. This degraded somewhat by the addition of more peroxide to about 140 $ohm^{-1}$ $cm^{-1}$. The conductivity was measured as a function of temperature and the results are listed below in Table I, which values were used in constructing the curve for Composition I in the FIG. 1.

In this case, the ratio R of the specific conductivity at temperature T ($\sigma_T$) to the room temperature specific conductivity ($\sigma_{RT}$) is plotted against obsolute temperature. Here, $\sigma_{RT}$ is 140 $ohm^{-1}$ $cm^{-1}$.

TABLE I

| Temp. °K. | R |
|---|---|
| 300 | 1.00 |
| 273 | 1.00 |
| 253 | 1.00 |
| 201 | 0.96 |
| 180 | 0.92 |
| 162 | 0.92 |
| 143 | 0.85 |
| 77 | 0.72 |

Significant losses in conductivity were noted upon exposure of the treated sample above to water vapor. Thus, when a few drops of water were placed in the bottom of the reactor so that the water vapor could saturate the closed container, there was a drop in conductivity by a factor of about 103 from its highest previous value and 3×102 from the value immediately before introducing the water vapor. Application of vacuum restored some but not all of the original conductivity. The doped polyacetylene even after this treatment was about 105 times as conducting as the original untreated polymer. The surface of the doped polyacetylene became tarnished during treatment with gaseous bisfluorosulfuryl peroxide and the polymer lost its flexibility becoming hard and brittle.

EXAMPLE 2

The apparatus used in this example was the same as illustrated in FIG. 2. A cis-polyacetylene strip was prepared as described in Example 1, and attached to the four platinum electrodes as described above. A magnetic stirring bar was used in the bottom of the reactor to insure uniform concentrations of dissolved peroxide in the solvent.

Initially, the reactor was charged with liquid $SO_2F_2$(−111° C.) which had been pretreated by storage over dry KF to remove any adventitious HF. The conductivity of the strip was monitored before and after the addition of the $SO_2F_2$, and was found to be highly insulating and unaffected by the solvent.

Addition of bisfluorosulfuryl peroxide was made by increments of 1.25 mmoles (0.025 grams each) and was made initially by condensing the gas into the stirring liquid at −111° C. Later runs were conducted by additions at −196° C., followed by warming to −111° C. and stirring. The addition of the $S_2O_6F_2$ caused an initial increase in conductivity of the polyacetylene and the conductivity continued to increase over a period of about 2½ days. During this time, the temperature never exceeded −78° C. When the value of the conductivity had reached a maximum and a further increments of peroxide failed to produce improvement even after 3 hrs. of additional stirring, the liquid was poured into the evacuated bulb which was at −196° C. Some of the $SO_2F_2$ was then condensed back into the reactor to wash the doped polyacetylene strip and then again poured into the bulb. This was repeated 3 times. The side arm stopcock was then closed and the bulb removed and the $SO_2F_2$ and any unused peroxide discarded. The reactor was then filled with dry nitrogen gas to facilitate heat transfer and was thermally stabilized at room temperature and various lower temperatures. The conductivity of the strip was measured at these temperatures and the results are listed below in Table II, which values were used in constructing the curve for Composition II in the FIG. 1. Here, the room temperature specific conductivity is 470 $ohm^{-1} cm^{-1}$.

TABLE II

| Temp. °K. | R |
|---|---|
| 298 | 1.00 |
| 248 | 1.02 |
| 208 | 1.05 |
| 195 | 1.05 |
| 162 | 1.04 |
| 136 | 1.02 |
| 115 | 1.00 |
| 77 | 0.93 |
| 38 | 0.87 |

EXAMPLE 3

The apparatus and method used in this example were similar to that described in Example 2 except the polyacetylene strip had a density of 0.94 g./cc. and was produced by compacting a cis polyacetylene gel, discussed hereinabove, before and after drying. The weight of the obtained strip was 0.181 grams, and was 0.61 millimeters thick, 7.6 millimeters wide and 25 millimeters long between the center leads.

The $SO_2F_2$ solvent (30 ml) had been stored over dry KF prior to use and its addition had no effect on conductivity. Addition of bisfluorosulfuryl peroxide (72.3% purity) was made in increments of about 1.25 m moles (0.025 grams) each and was made by condensation of the gas into the cell at −196° C. followed by warming to −111° C. and stirring. Reaction, as indicated by conductivity, was slow at this temperature so the mixture was allowed to warm slowly to −95° C. over a period of 1 to 2 hours and then allowed to warm to −80° C. This procedure was repeated for the first three additions. Further additions over 6 days were made by condensation of the peroxide at −196° C. and warming to −80° C. The process was then repeated for the remaining time using −56° C. as a reaction temperature. The entire reaction was carried out over a 10 day period with additions of twelve equal amounts of the peroxide.

When the value of the conductivity had reached a maximum value, the $SO_2F_2$ and the remaining peroxide were poured at −78° C. into the evacuated bulb which was maintained at −196° C. The $SO_2F_2$ was transferred back into the gas phase by condensation to wash the polymer strip. This was repeated five times. The material was then dried under vacuum. The resulting doped polymer had a room temperature specific conductivity of about 700 $ohm^{-1} cm^{-1}$. The variation with temperature was conducted in an atmosphere of dry nitrogen for better thermal conductivity and lowering the temperature through the use of various slash baths. The temperature was measured using a chromel-alumel thermocouple. The results are listed below in Table III, which values were used in constructing the curve for Composition III in FIG. 1.

TABLE III

| Temp. °K. | R |
|---|---|
| 296 | 1.00 |
| 273 | 1.04 |
| 250 | 1.07 |
| 227 | 1.10 |
| 206 | 1.11 |
| 193 | 1.12 |
| 156 | 1.13 |
| 137 | 1.13 |
| 111 | 1.11 |
| 77 | 1.06 |
| 60 | 1.01 |
| 40 | 0.97 |
| 35 | 0.95 |
| 4 | 0.91 |

The weight of the sample after reaction was 0.230 grams for a weight gain of 0.049 grams or 27%. The final thickness was 0.82 mm (average) corresponding to a 34% increase in thickness. The color and flexibility of the composition remained nearly the same as the starting polyacetylene with little tarnishing or embrittlement.

We claim:

1. A composition comprising a solid polyacetylene having density at least about 0.90 g/cc and having incorporated therein a fluorine-containing peroxide of the group consisting of bisfluorosulfuryl peroxide, bistrifluoromethylsulfuryl peroxide, bistrifluoroacetyl peroxide, bistrifluoromethyl trioxide and bistrifluoromethyl peroxide and their mixtures; wherein the specific direct current conductivity of the composition is greater than that of said polyacetylene alone, as measured by the four-probe method at room temperature; said peroxide being present in an amount of about 0.001 to 40 weight percent of said polyacetylene present.

2. The composition of claim 1 wherein the specific conductivity of said composition is at least about 100 times greater than said polyacetylene alone.

3. The composition of claim 1 exhibiting a specific conductivity of at least about $10^2$ $ohm^{-1} cm^{-1}$ at room temperature as measured by the four-probe method.

4. The composition of claim 1 exhibiting the electrical properties of a semiconductor.

5. The composition of claim 1 exhibiting metal-like conductivity.

6. The composition of claim 5 wherein said metal-like conductivity is exhibited above about 150° K.

7. The composition of claim 1 wherein said fluorine-containing peroxide is bisfluorosulfuryl peroxide.

8. The composition of claim 1 wherein said polyacetylene is at least about 70% in the cis or trans form.

9. The composition of claim 8 wherein said polyacetylene is partially axially oriented.

10. The composition of claim 1 wherein said polyacetylene is about 86% in the cis form, has a density of about 0.94 g./cc., and bisfluorosulfuryl peroxide is the peroxide present in an amount of about 15 to 35 weight percent of the polyacetylene present.

11. A process for preparing the composition of claim 1 comprising: contacting a solid polyacetylene with a fluorine-containing peroxide in an inert liquid solvent for the peroxide, at a temperature from about −120° to −50° C. and at an initial pressure lower than the room temperature vapor pressure of the peroxide, to incorporate about 0.001 to 40 weight percent of the peroxide, based on the weight of polyacetylene, in the composition.

12. The process of claim 11 wherein said solvent is sulfuryl difluoride.

13. The process of claim 11 wherein the contacting is conducted by incremental addition of the peroxide until maximum specific conductivity of the composition is obtained.

14. The process of claim 11 wherein the initial pressure in the process is lower than atmospheric.

* * * * *